US008262446B2

(12) United States Patent
Seelig et al.

(10) Patent No.: US 8,262,446 B2
(45) Date of Patent: Sep. 11, 2012

(54) GAMING DEVICE AND METHOD OF USE

(75) Inventors: Jerald C. Seelig, Galloway, NJ (US); Lawrence M. Henshaw, Hammonton, NJ (US)

(73) Assignee: Atlantic City Coin & Slot Company, Inc., Pleasantville, NJ (US)

( * ) Notice: Subject to any disclaimer, the term of this patent is extended or adjusted under 35 U.S.C. 154(b) by 506 days.

(21) Appl. No.: 12/428,584

(22) Filed: Apr. 23, 2009

(65) Prior Publication Data

US 2009/0270164 A1 Oct. 29, 2009

Related U.S. Application Data

(60) Provisional application No. 61/048,283, filed on Apr. 28, 2008.

(51) Int. Cl.
*A63F 9/00* (2006.01)

(52) U.S. Cl. ..... 463/9; 463/11; 463/23

(58) Field of Classification Search ..... 463/9–11, 463/16–22, 29–31, 34
See application file for complete search history.

(56) References Cited

U.S. PATENT DOCUMENTS 5,411,271 A * 5/1995 Mirando ..... 463/9
6,227,971 B1 5/2001 Weiss
6,287,197 B1 * 9/2001 Dickinson et al. ..... 463/31
7,631,872 B2 * 12/2009 Roemer et al. ..... 273/273

* cited by examiner

*Primary Examiner* — Julio J Maldonado
*Assistant Examiner* — Daniel Shook
(74) *Attorney, Agent, or Firm* — Ian F. Burns & Associates, P.C.

(57) ABSTRACT

A gaming apparatus allows a player to play a memory game. The gaming apparatus includes a gaming device that is adapted to accept a wager and allow a player to play a game. A display device is mounted in association with the gaming device. A player input device is mounted in association with the gaming device. A controller is in communication with the gaming device, the display device and the player input device. The controller causes the display device to display a first set of indicia and then display a plurality of sets of indicia. The plurality of sets of indicia includes the first set of indicia. A player is allowed to choose one of the plurality of sets of indicia using the player input device. A prize is awarded, if the set of indicia chosen is the first set of indicia.

32 Claims, 15 Drawing Sheets

GAMING DEVICE AND METHOD OF USE

CROSS REFERENCE TO RELATED AND CO-PENDING PATENT APPLICATIONS

This patent application claims priority to U.S. provisional patent application Ser. No. 61/048,283, filed on Apr. 28, 2008. The contents of the foregoing application are herein incorporated by reference in entirety.

FIELD OF THE INVENTION

The present invention relates to gaming devices and, more particularly, to a gaming device that includes a memory challenge for a game player.

BACKGROUND

Gaming devices are well known in the art and a large variety of gaming devices have been developed. In general, gaming devices allow users or players to play a game. In many casino-type gaming devices, the outcome of the game depends, at least in part, on a randomly generated event. For example, a gaming device may use a random number generator to generate a random or pseudo-random number (hereinafter, both types are referred to as a "random number").

The random number can be used to determine a game outcome. For example, the random number may then be compared to a predefined table to determine a corresponding outcome of the event. If the random number falls within a certain range of numbers on the table, the player may win the corresponding predefined prize. The table may also contain display information that allows the gaming device to generate a display that corresponds to the outcome of the game. The gaming device may present the outcome of the game on a large variety of display devices, such as mechanical spinning reels or video screens.

Some gaming devices award bonus prizes in addition to prizes that are awarded in a primary game. Of course, the prize in the primary game may simply be the opportunity to play the bonus game. A bonus prize is generally defined as a prize in addition to the prize obtained from the primary game and that is awarded to the player when a predefined event occurs. An example of a bonus game can be found in U.S. Pat. No. 5,848,932 to Adams. Adams discloses a primary game having three spinning game reels and a bonus game having a bonus display with one spinning wheel. The spinning wheel is divided into multiple sections, and each section has a symbol representing a prize. When predetermined indicia are displayed on the spinning game reels of the primary game, the wheel of the bonus display spins and stops. The bonus prize is displayed as the symbol on the wheel being pointed to by a pointer. The bonus prize is awarded in addition to any prizes awarded in the primary game. Another bonus game is disclosed in Baerlocher et al. (U.S. Pat. No. 6,336,863). Baerlocher et al. discloses a slot machine with a bonus award display. The bonus award display has a bonus wheel and a mechanical, movable pointer.

Some gaming devices such as video poker and blackjack involve player skill and decision making. The player decides whether to take additional cards in blackjack type games and decides which cards to hold and discard in poker type games. These games generally require both a certain level of skill at the game and luck to be successful. Gaming devices that involve skill are interactive and are enjoyable for people to play. Many people have grown accustomed to playing games of skill such as home video games and computer games.

Many gaming machines do not appeal to people who have played skill type games. Conventional gaming machines, where the outcome is based solely on a randomly generated outcome; may appear dull and boring to some game players. Players who enjoy skill games are always searching for new games that provide a stimulating and enhanced gaming experience that is mentally challenging.

SUMMARY

Advantages

The various embodiments of the present invention may, but do not necessarily, achieve one or more of the following advantages:

provide a highly attractive and entertaining device for conducting games;

provide a highly attractive and entertaining device for displaying prizes;

provide a gaming device that allows players to use their skill to win a prize;

provide a memory game;

provide a gaming device that can display a wide variety of indicia;

provide a gaming method that can hold the attention of game players;

provide a gaming method that game players find challenging;

provide a bonus game that can be used with a base game;

provide a gaming device that provides players with the illusion that their skill can influence the game outcome;

the ability to attract more patrons to play a game; and the ability to encourage players to play longer on a gaming apparatus.

These and other advantages may be realized by reference to the remaining portions of the specification, claims, and abstract.

BRIEF DESCRIPTION OF CERTAIN ASPECTS OF THE INVENTION

In one embodiment, the present invention comprises a gaming apparatus that allows a player to play a memory game.

In certain embodiments, the present invention relates to a gaming apparatus that includes a gaming device that is adapted to accept a wager and allow a player to play a game. A display device is positioned in association with the gaming device. A player input device is mounted in association with the gaming device. A controller is in communication with the gaming device and the display and the player input device. The controller causes the display device to display a first set of indicia and then display a plurality of sets of indicia. The plurality of sets of indicia includes the first set of indicia. A player is allowed to choose one of the plurality of sets of indicia using the player input device. A prize is awarded, if the set of indicia chosen is the first set of indicia.

In other embodiments, the present invention relates to a gaming method. The method includes displaying a first display having a first set of indicia and allowing a player to view the first set of indicia. A second display is displayed having a plurality of sets of indicia. The player is allowed to select one of the plurality of sets of indicia. If the set of indicia selected by the player is the same as the first set of indicia, a prize is awarded.

In another embodiment, the present invention relates to a gaming method. The method includes displaying a first set of indicia for a first time period and allowing a player to view the first set of indicia during the first time period. The first set of indicia and a second set of indicia are displayed for a second time period. The player is allowed to select one of the sets of indicia during the second time period. If the set of indicia selected by the player is the first set of indicia, a prize is awarded.

In a different embodiment, the present invention relates to a gaming apparatus that includes a gaming device that is adapted to accept a wager and allow a player to play a game. The gaming apparatus includes means for accepting a wager and playing a first game and means for displaying a first set of indicia. The gaming apparatus further includes means for displaying a plurality of sets of indicia. The plurality of sets of indicia including the first set of indicia. The gaming apparatus has means for selecting at least one of the plurality of sets of indicia and means for awarding a prize, if the selected set of indicia is the first set of indicia.

In yet another embodiment, the present invention relates to a gaming apparatus that includes a gaming device that is adapted to accept a wager and allow a player to play at least one game. A display is mounted in association with the gaming device. A player input device is mounted in association with the gaming device. A controller is in communication with the gaming device and the display, and the player input device. The controller is configured to display an image and ask a question about the image. The player is allowed to select an answer to the question. A prize is awarded, if the answer is correct.

In an additional embodiment, the present invention relates to a gaming method. The method includes displaying a first display having an image and allowing a player to view the image. A second display is shown that has a question about the image. The player is allowed to select an answer to the question. If the answer to the question is correct, a prize is awarded.

The above description sets forth, rather broadly, the more important features of the present invention so that the detailed description of the following preferred and other embodiments may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components as set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Certain embodiments of the invention are shown in the accompanying drawings wherein.

DESCRIPTION OF AT LEAST ONE EMBODIMENT OF THE PRESENT INVENTION

In the following detailed description of at least one embodiment of the present invention, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
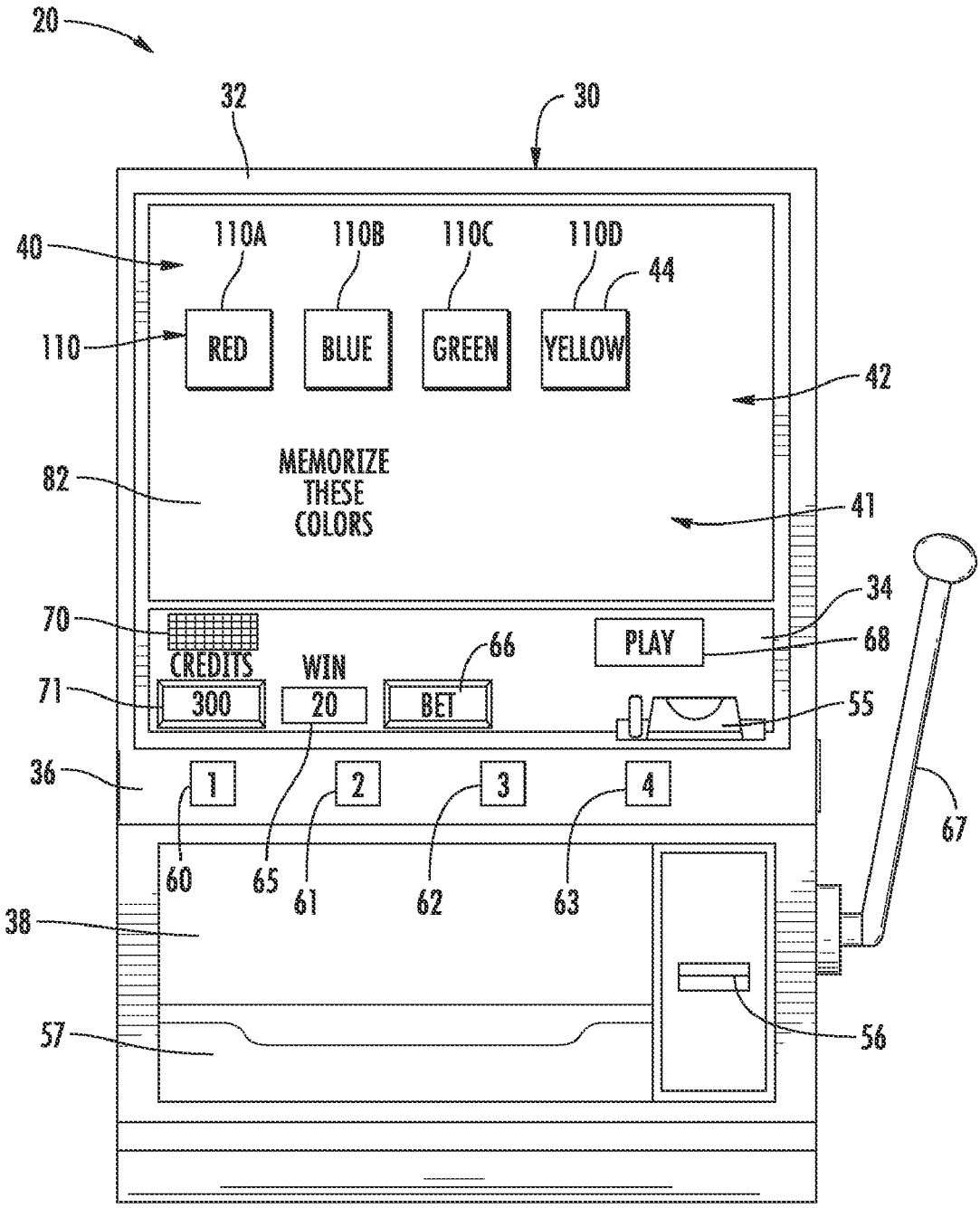
FIG. 1 is substantially a front elevation view of an embodiment of the gaming apparatus of the present invention.

As seen in FIG. 1, the present invention comprises a gaming machine, device or apparatus, generally indicated by reference number 20. In at least one embodiment, gaming apparatus 20 may be any of a large number of devices that are adapted to allow players to play a game, such as gaming devices typically found in arcade and casino environments, including arcade games, video games, gambling machines, video poker machines, slot machines, etc. In at least one embodiment, gaming apparatus 20 is further adapted to allow a player to place a wager and play a game.

Gaming apparatus 20 may include a housing 30 having a front panel 32, button panels 34 and 36 and panel 38. A display device such as video display 40 can be mounted to front panel 32. Display device or video display 40 can be any of a large number of conventional display devices such as video displays including CRT, LCD and plasma video displays. Video display 40 can show a wide variety of video presentations. One such display, as shown in FIG. 1, is a memory game display 42 with a background 41. Background 41 can be any suitable video presentation that is attractive and may draw player interest. In FIG. 1, background 41 is blank or empty.

Game display 42 has boxes, symbols or positions 110 including 110A, 110B, 110C and 110D. Various indicia 44 are displayed in each of boxes 110. Indicia 44 can be a wide variety of indicia including colors, numbers, shapes, symbols and pictures. In FIG. 1, indicia 44 are shown as the colors red, blue, green and yellow in that order. Box 110A is red. Box 110B is blue. Box 110C is green and box 110D is yellow.

Gaming apparatus 20 may further include a device for accepting value (including currency and/or currency equivalents), such as a coin slot 55 and bill acceptor, voucher reader, or value acceptor 56. In order to accrue credits that may be used to play the gaming apparatus 20, the player inserts paper currency or other suitable script or gaming coupons into the value acceptor 56 behind which, on the interior of the gaming machine, is mounted a bill acceptor which takes in and validates the currency. The monetary value of the inserted currency is then applied to the credit meter 71, the credits on which the player may use to play the gaming machine.

A payout mechanism (not shown) and a coin receptacle 57 may be provided for awarding prizes or for dispensing value to players cashing out and retiring from a game. A printer (not shown) may also be provided for printing out cashless vouchers (not shown). A pay table (not shown) may further be provided to allow a player to see what the payout is for a winning event.

Button panel 34 can include a credit meter 71 and a win meter 65. A handle 67 or a play button 68 allows the player to start the game. Other buttons allow the player to make a wager using the BET button 66.

Gaming apparatus 20 also has a button panel 36 which includes selection buttons that the player may press to activate various actions or make selections during game play. Buttons 60, 61, 62 and 63 are located on button panel 36.

Instead of using buttons on the button panel, the video display 40 can be provided with touch screen locations (not shown) that the player would touch to make a selection. Gaming apparatus 20 may also include speakers 70 for playing music or announcements.

Gaming apparatus 20 may stand alone as a primary or base game or may be a bonus game that is played in conjunction with a base game. For example, a conventional slot machine may be the primary or base game and gaming apparatus 20 may be mounted with the primary game. In an embodiment, gaming apparatus 20 may be mounted on top of the primary game.

The primary game may randomly determine a bonus qualifying event or outcome and enable the play of a bonus game on gaming apparatus 20 by a game player. Several gaming apparatuses 20 may be connected together and in communication with each other to form a network of gaming apparatuses. The network of gaming apparatuses may form a community game.

Figure 2:
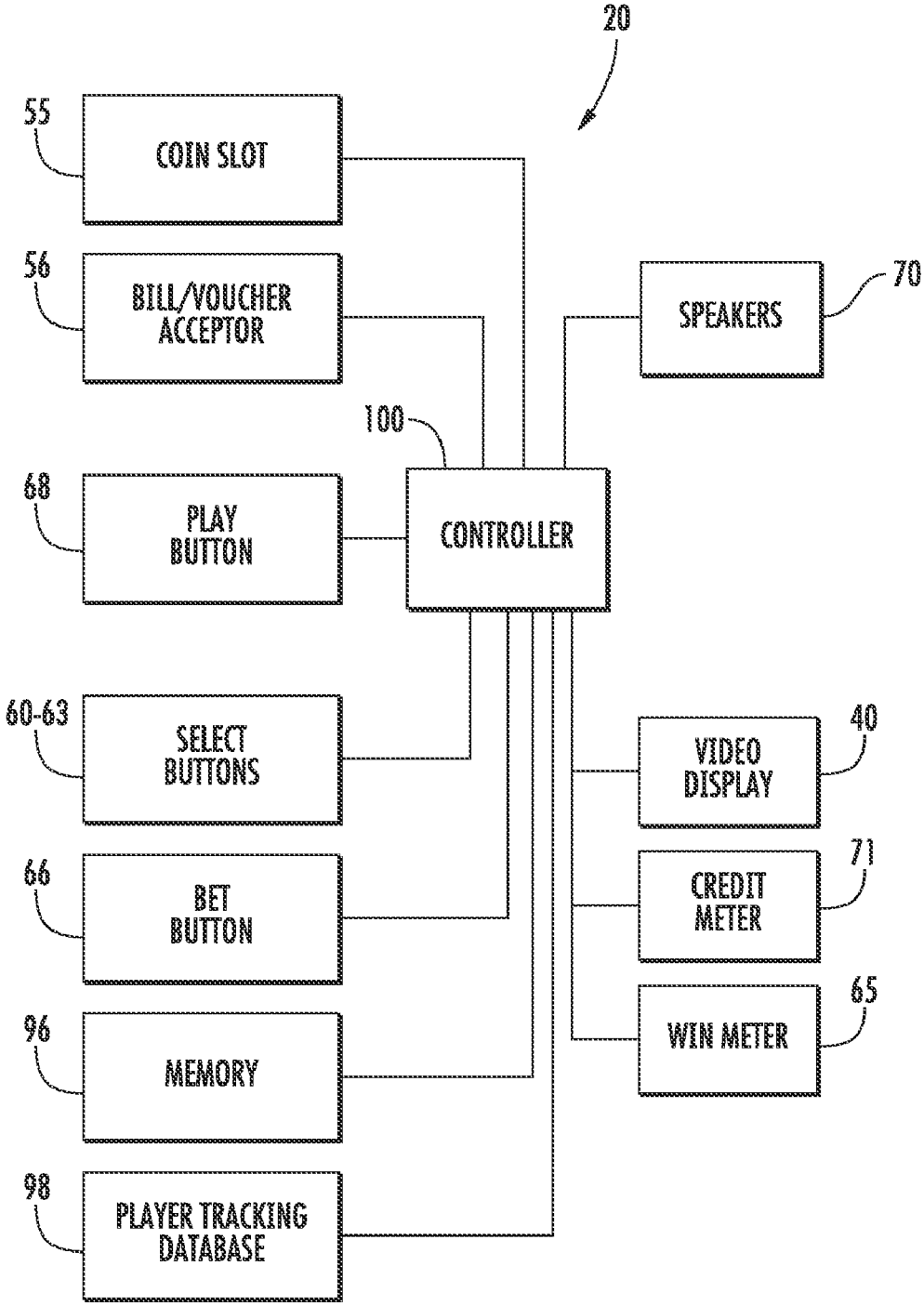
FIG. 2 is substantially a schematic diagram showing components of an embodiment of the gaming apparatus.

Referring now to FIG. 2, a schematic diagram of some components that may be included in certain embodiments of gaming apparatus 20 are shown. Gaming apparatus 20 may include a coin slot 55 and value acceptor 56 configured to accept value from the player in the form of paper currency, coins, player cards, tickets, vouchers, tokens, or other forms of value. Coin slot 55 and value acceptor 56 may be in communication with a controller 100. Controller 100 may be any suitable controller such as a microprocessor. Controller 100 may be in communication with input devices such as play button 68 and BET button 66. Controller 100 may detect insertion of value into coin slot 55 and value acceptor 56 and may prompt the player to start a game by activating play button 68. Once controller 100 senses a signal to start the game, controller 100 may be configured to produce a random number and activate video display 40.

Video display 40 may be configured to a first set of indicia or display boxes 110 and indicia 44 located in the boxes including symbols, characters, numbers, letters, pictures or colors on video display 40. Controller 100 may further be configured to determine a game outcome based upon the random number and a predetermined pay table as is known in the art.

Controller 100 can also be in communication with a memory 96 and a player tracking database 98. Memory 96 may comprise a random access memory or a disc drive and may store information generated during game play of gaming apparatus 20. Player tracking database 98 may store historical information about players and their playing habits using player tracking cards as is well known in the industry.

Gaming apparatus 20 may further include a speaker 70. Controller 100 may cause speaker 70 to create a festive and lively winning atmosphere to elicit interest and entertainment from both the player and adjacent patrons.

Referring back to FIG. 1, the operation of gaming apparatus 20 will be explained. Initially, a game player makes a deposit into coin slot 55 or value acceptor 56. The credit meter 71 displays the number of credits. Next, the game player would pull handle 67 or depress play button 68 to begin the game.

Controller 100 may generate a random number and determine various game parameters. The various game parameters can include determining the difficulty of the game, the indicia that are displayed to memorize and the maximum prizes that may be awarded. Various levels of game difficulty and possible prizes may be assigned to a pay table. For example, small prizes may be associated with the display of indicia that are easy to remember. Large prizes may be associated with the display of indicia that are harder to remember.

Controller 100 can determine and assign color indicia 44 to boxes 110A-D. Controller 100 can cause video display 40 to show a first set of indicia as four colored boxes 110A-D for a pre-determined period of time. More or fewer boxes of indicia may be shown. At this point, the player would memorize or remember the colors shown in boxes 110A-D. In addition, the player may be required to memorize or remember the order or sequence of the colors in boxes 110A-D. An instruction set 82 may prompt the player to memorize the colors. In other embodiments, the player may need only to memorize or know the specific colors that are shown and may not need to know the order or sequence that the colors are arranged in.

Figure 3:
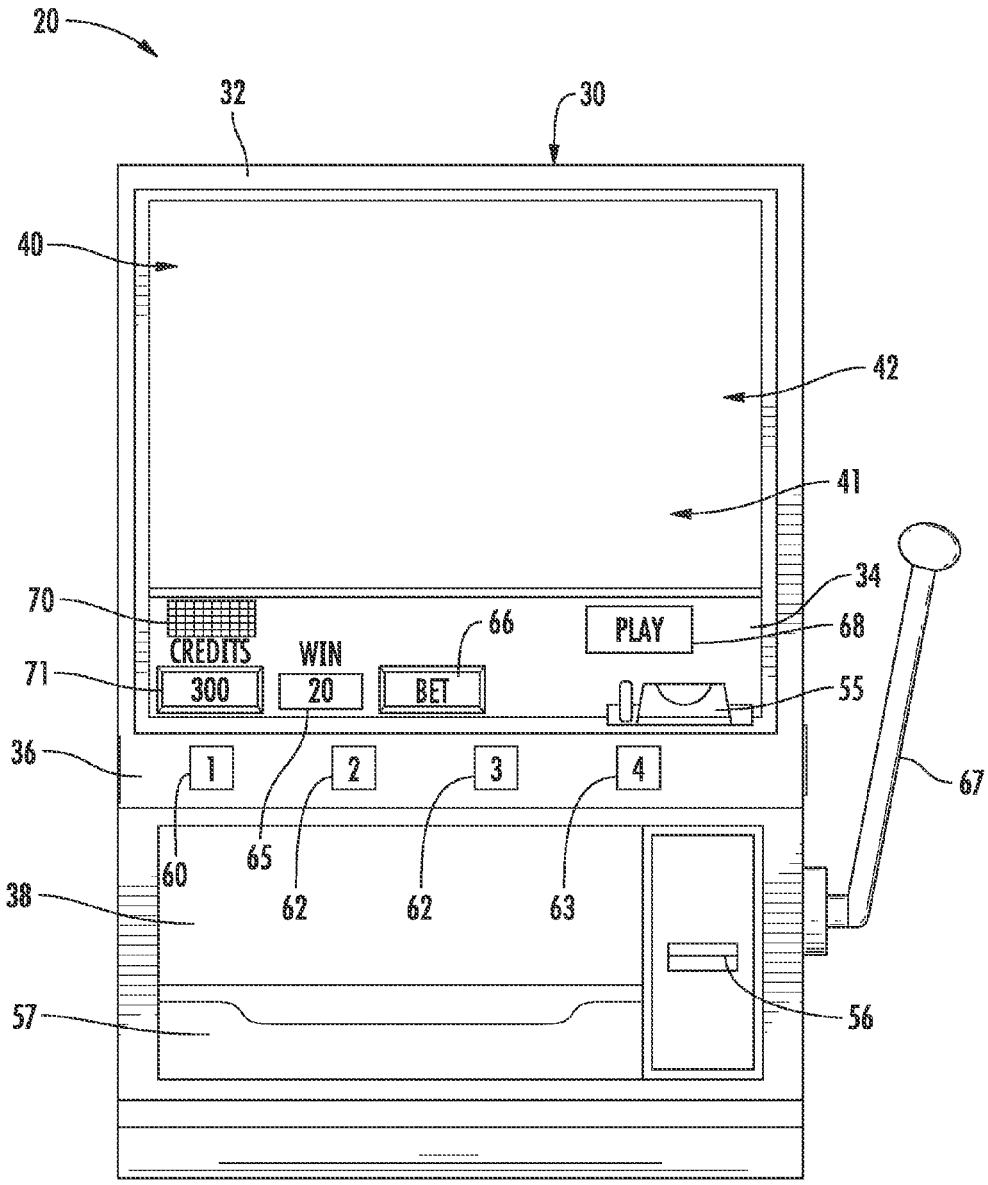
FIG. 3 is substantially a front elevation view of the gaming apparatus of FIG. 1 showing an embodiment of a game display.
Figure 4:
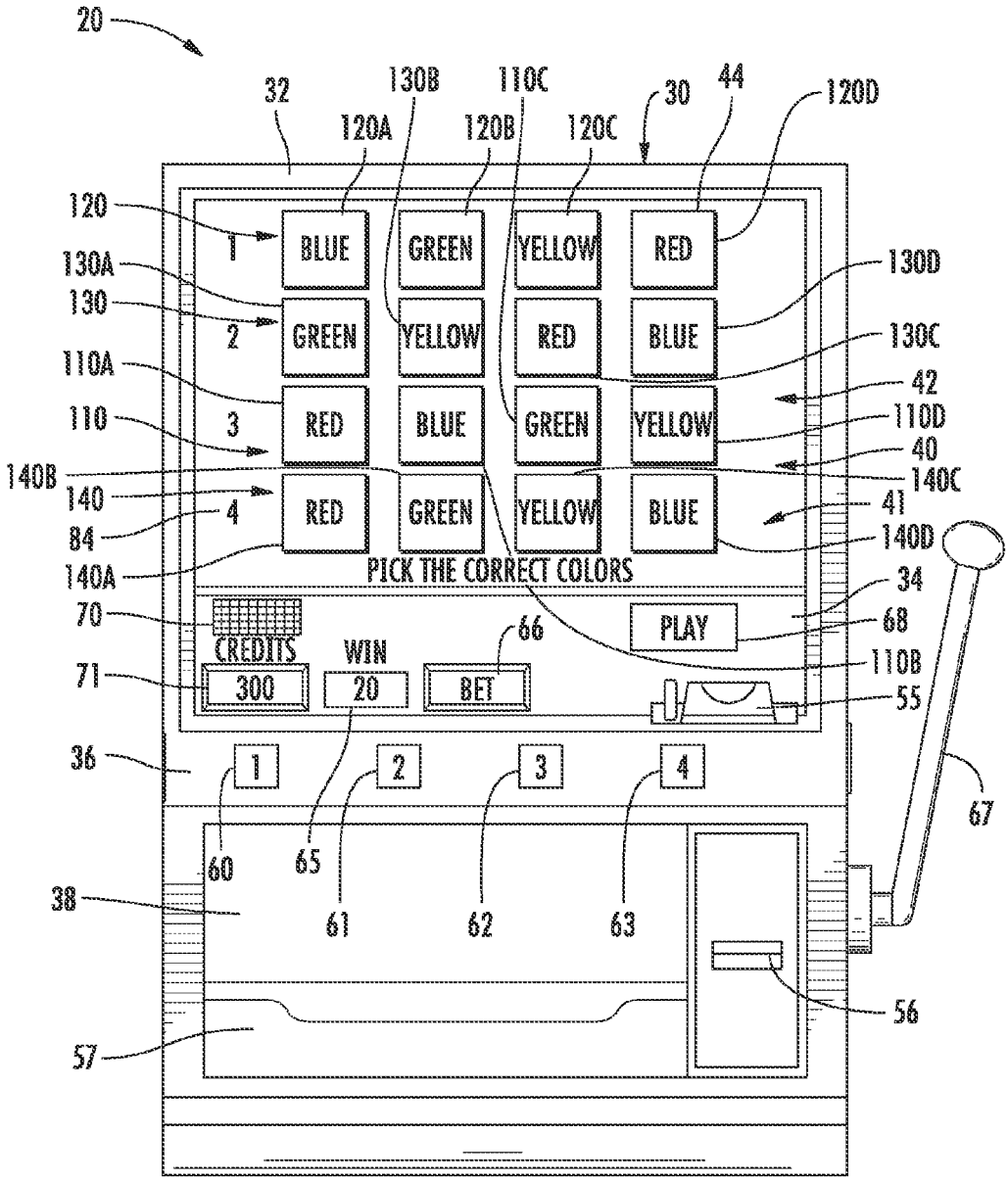
FIG. 4 is substantially a front elevation view of the gaming apparatus of FIG. 1 showing another embodiment of a game display.

Next, controller 100 then causes a blank video screen 40 to be displayed for a pre-determined period of time as shown in FIG. 3. Turning now to FIG. 4, controller 100 is shown displaying a multiple choice display of several sets of indicia or sets of boxes 110, 120, 130 and 140 containing colored indicia 44 on video display 40. In addition, the multiple choice display of colored boxes 110, 120, 130 and 140 are labeled with a label 84 such as, "1, 2, 3 or 4".

Label 1 corresponds to a second set of indicia 120 and includes blue box 120A, green box 120B, yellow box 120C and red box 120D. Label 2 corresponds to a third set of indicia and includes green box 130A, yellow box 130B, red box 130C and blue box 130D. Label 3 corresponds to the first set of indicia 110 and includes red box 110A, blue box 110B, green box 110C and yellow box 110D. Label 4 corresponds to a fourth set of indicia 140 and includes red box 140A, green box 140B, yellow box 140C and blue box 140D.

The display of four sets of indicia 110, 120, 130 and 140 may be displayed for a pre-determined period of time.

Controller 100 then prompts the player to select the set of indicia or boxes 110, 120, 130 or 140 that is the same as the set of indicia that were previously displayed on video display 40. The player uses buttons 60, 61, 62 and 63 to select the sets of indicia labeled "1, 2, 3 or 4". The player needs to remember the correct colors and sequence of colors that are displayed. The player may be given a pre-determined period of time to use the buttons to make a selection. If after the period of time the player has not made a selection, controller 100 may randomly make a selection for the player.

Figure 5:
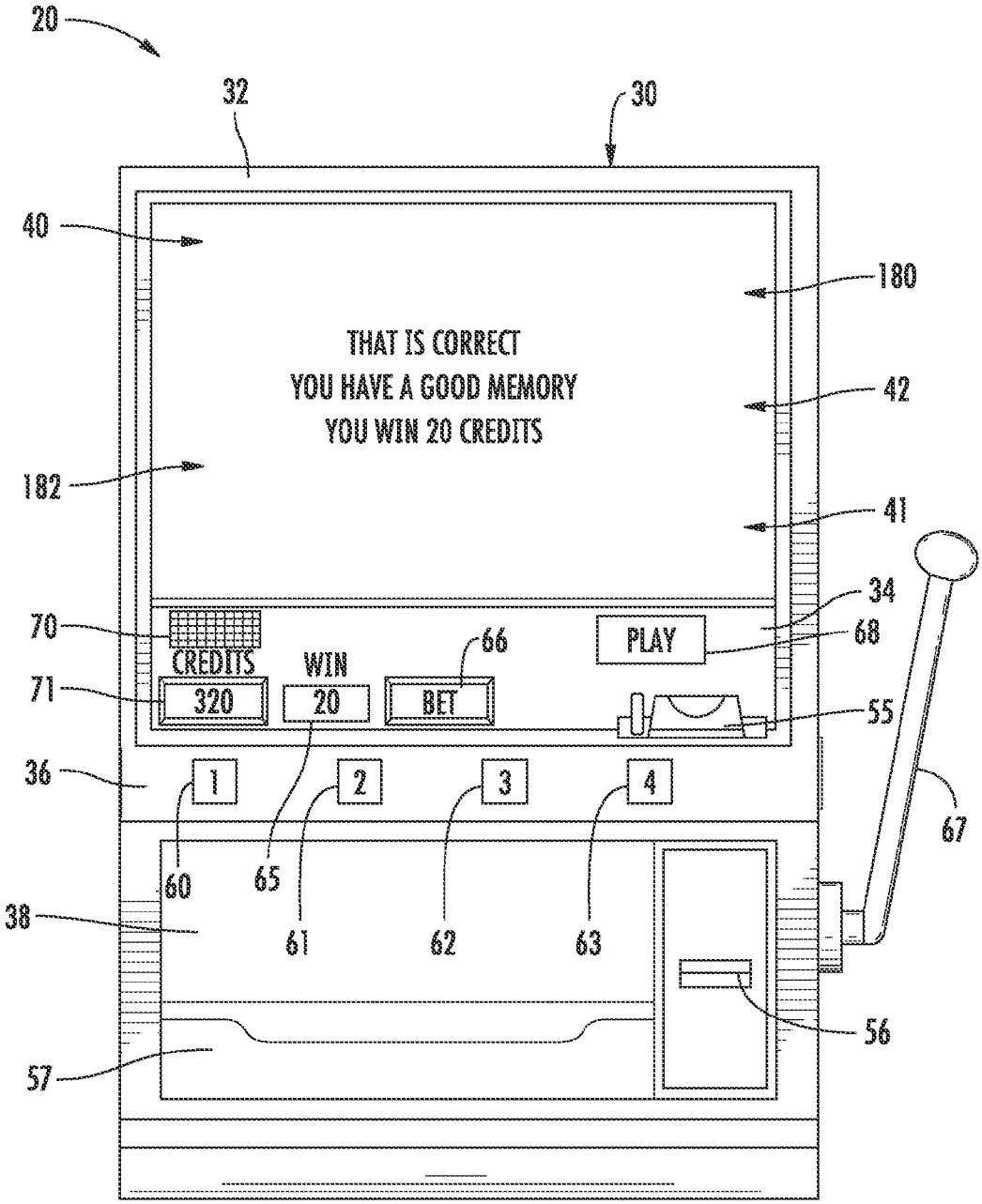
FIG. 5 is substantially a front elevation view of the gaming apparatus of FIG. 1 showing an alternate embodiment of a game display.

If the player correctly selects the set of indicia or colored boxes that is the same as the previously displayed sequence of indicia or colored boxes, the player is awarded a prize. As shown in FIG. 5, the player has correctly selected the set of colored boxes labeled "3" which matches the previously shown first set of indicia 110. Video display 40 can show a message 180 indicating that the player has a good memory and can show game information 182 indicating the game outcome including any prizes and the amount the player has won. In the embodiment shown in FIGS. 1-4, the player must select the correct identity and order of the indicia in order to win a prize.

Controller 100 then credits any prizes that correspond to the game outcome to win meter 65 and credit meter 71. While indicia 44 was shown as colors, a wide variety of indicia 44 can be used to be memorized such as numbers, shapes or symbols.

Game Method

Figure 6:
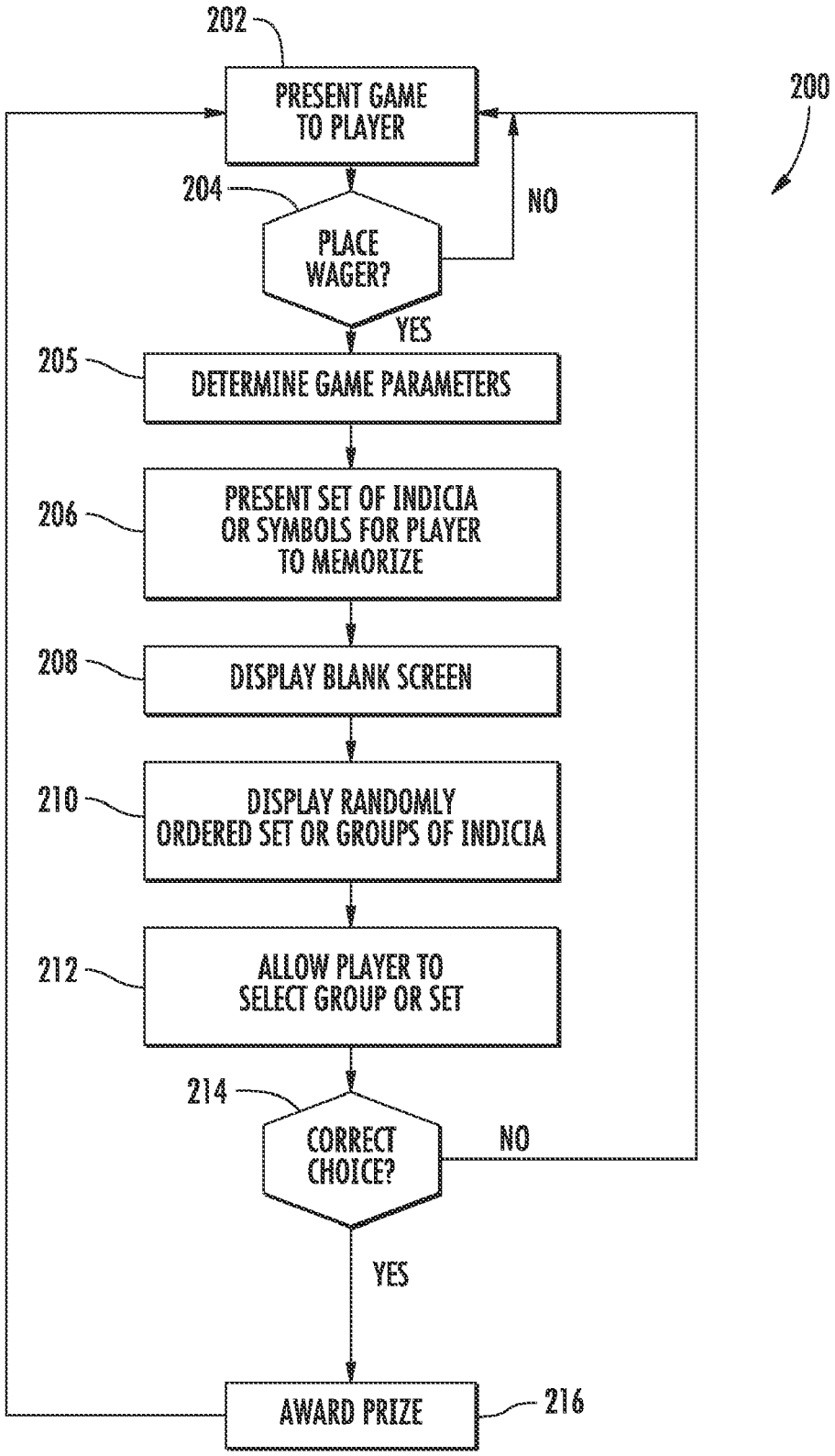
FIG. 6 is substantially a flowchart of a gaming method of the present invention.

Tuning now to FIGS. 1 and 6, a method 200 of playing gaming apparatus 20 is shown. The game is presented to the player in step 202. A player is allowed to place a wager on gaming apparatus 20 in step 204. At step 205, controller 100 can determine various game parameters. Step 205 may include determining the difficulty of the indicia that are shown to be remembered and the value of any prizes for a correct choice by the player. The game parameters may be pre-determined or may be randomly selected from a list of game parameters.

For example, during one game cycle, the indicia shown may be easy to memorize. An example of indicia that would be easy to memorize would be only a few indicia such as three indicia. A small prize amount may be awarded to the player for correctly remembering and choosing the correct three indicia.

During another game cycle, the indicia shown may be harder to memorize. An example of indicia that would be hard to memorize would be a large number of indicia such as ten indicia. A larger prize amount may be awarded to the player for correctly remembering and choosing the correct ten indicia. The player's skill at memorizing and remembering the indicia determines if the game outcome is a winning outcome.

In one embodiment, the value of any prizes may be fixed for a correct choice by the player. In another embodiment, controller 100 may determine at step 205, either randomly or otherwise, the value of any prizes awarded for a correct choice by the player.

At step 206, the set of indicia of symbols or colors for the player to memorize are displayed or shown to the player for a period of time. The player may be prompted to remember the set of indicia. Next, a blank or empty video display screen is shown in step 208 for another period of time. Other types of displays may also be shown in step 208 such as animation, movie clips or music videos. At step 210, a group or several sets of indicia or symbols are shown to the player on video display 40 for period of time. At step 212, the player is allowed to select one of the sets of indicia using buttons 60-63.

At decision 214, method 200 checks to see if the player's choice is correct in matching the previously shown set of indicia. If the player's choice is not correct, method 200 returns to step 202. If it is determined at decision 214 that the player's choice is correct, method 200 proceeds to step 216 where any prizes are awarded.

Method 200 then returns to step 202 where the player is allowed to play the game again. If the player chooses to play another game, the next game may be more difficult. In one embodiment, they may only play another game, if the outcome of the previous game was a game winning outcome. In this example, the next game would be more difficult.

In another embodiment, if a player loses the first game, the controller may adjust the next game to be easier. In this manner, the game can be adjusted to be challenging to game players of different skill levels.

The steps shown in the flowchart do not necessarily imply that the steps have to take place in a particular order. The order of steps may be varied; some steps may be eliminated; and, some steps may be replaced with other steps. Such variations still fall within the scope of the invention.

Second Embodiment

Figure 7:
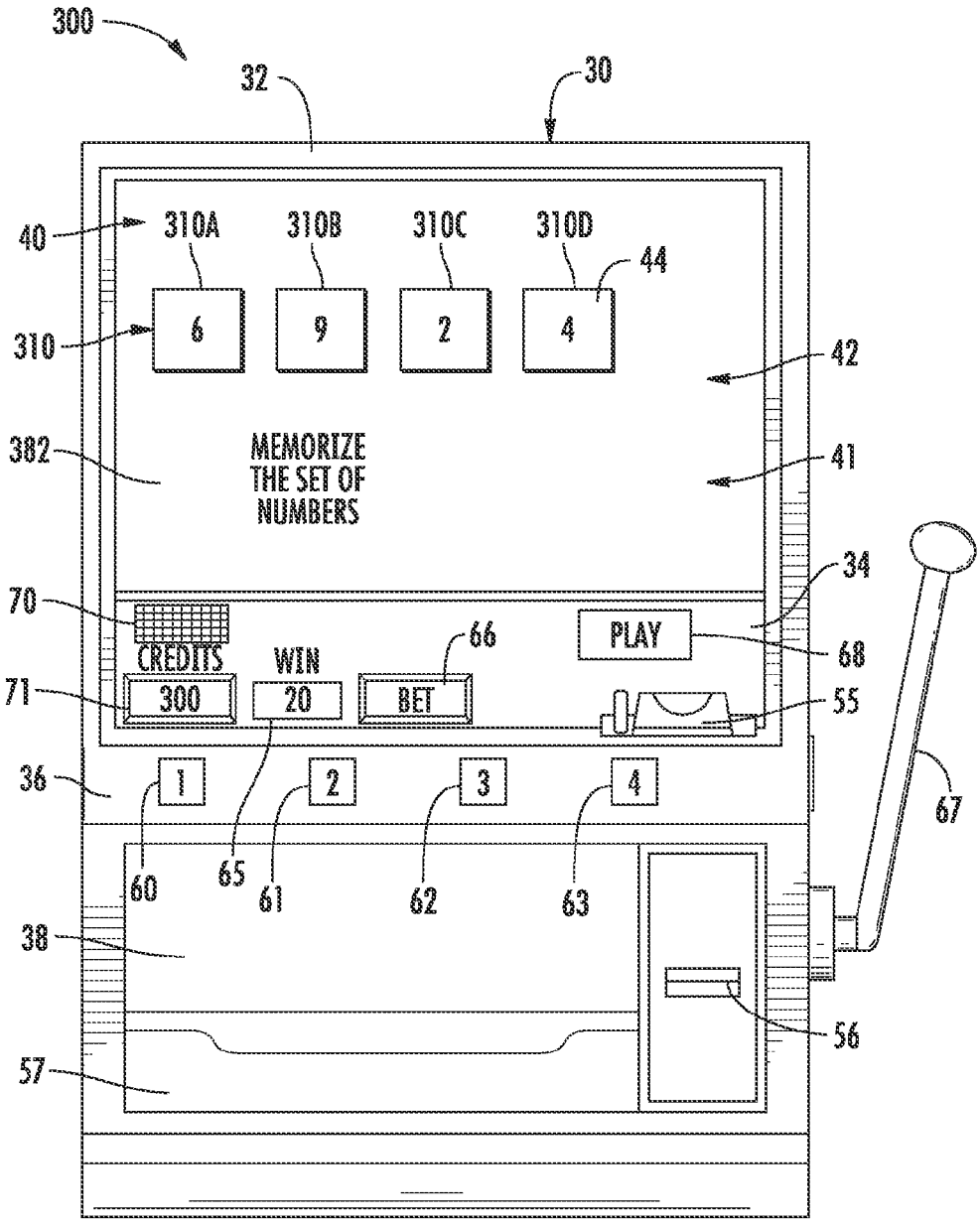
FIG. 7 is substantially a front elevation view of another embodiment of the gaming apparatus of the present invention.

With reference now to FIGS. 2 and 7, another embodiment of the present invention is shown. A gaming apparatus, generally indicated by reference number 300 is shown. Gaming apparatus 300 is similar to gaming apparatus 20 except that indicia 44 are now numbers instead of colors.

Game display 42 has a set of boxes or set of indicia 310 including 310A, 310B, 310C and 310D. Various indicia 44 are displayed in each of the boxes. Indicia 44 can be a wide variety of indicia. Box 310A contains the number "6". Box 310B contains the number "9". Box 310C contains the number "2" and box 310D contains the number "4". An instruction set 382 may prompt the player to memorize the numbers. Controller 100 can cause video display 40 to show the first set of indicia 310 for a pre-determined period of time.

Figure 8:
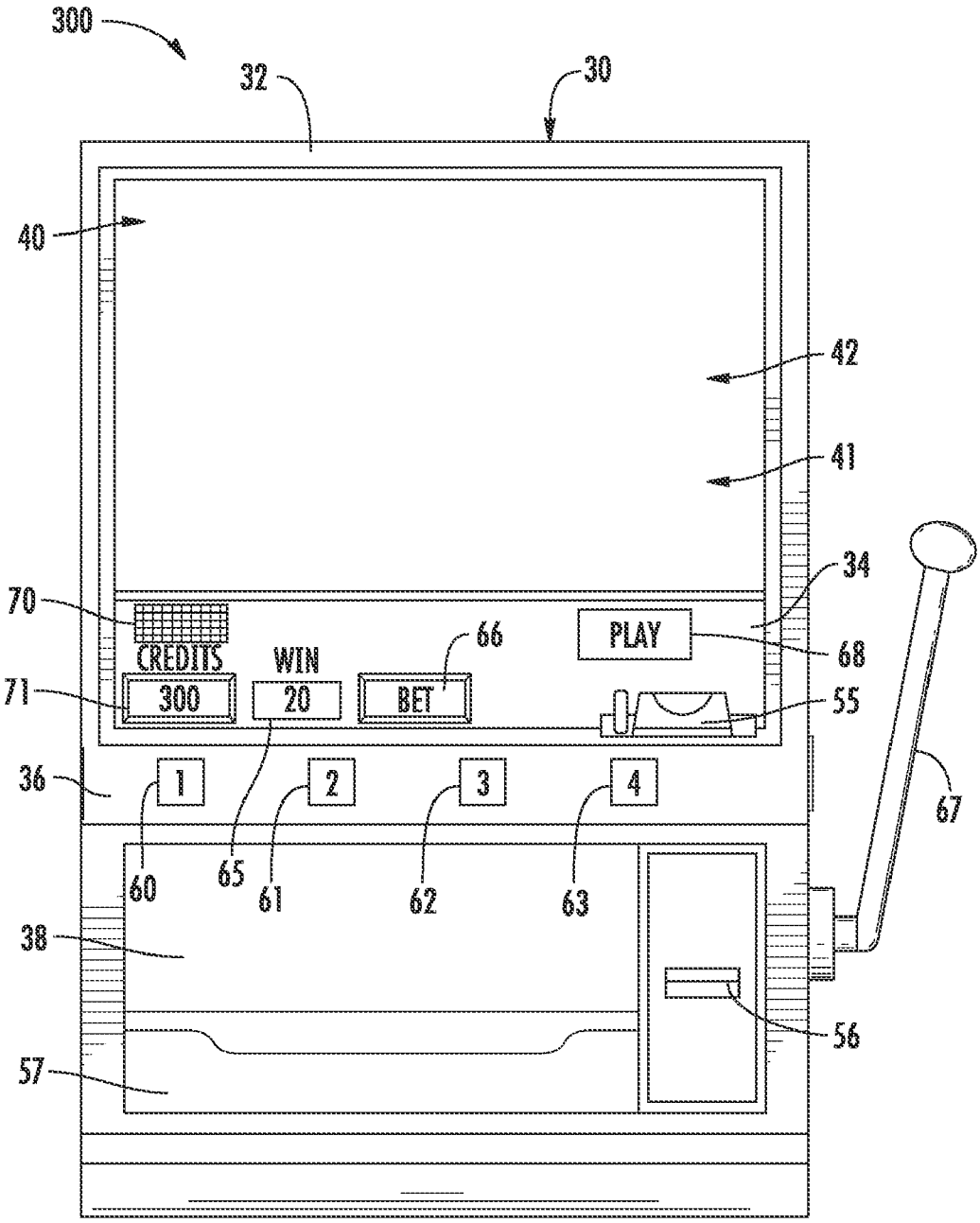
FIG. 8 is substantially a front elevation view of the gaming apparatus of FIG. 7 showing an embodiment of a game display.
Figure 9:
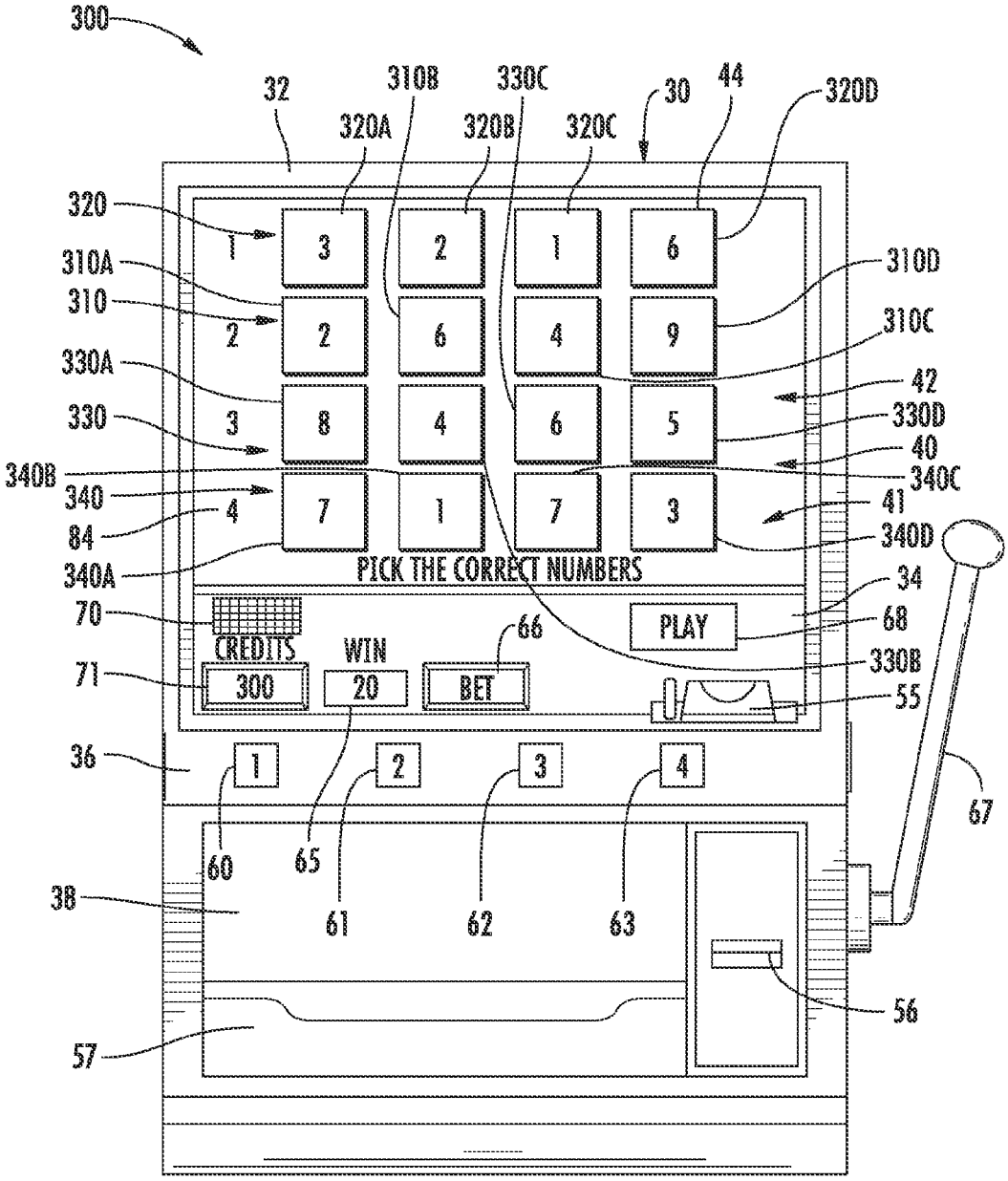
FIG. 9 is substantially a front elevation view of the gaming apparatus of FIG. 7 showing another embodiment of a game display.

Next, controller 100 then causes a blank video screen 40 to be displayed for a pre-determined period of time as shown in FIG. 8. Turning now to FIG. 9, controller 100 is shown displaying a multiple choice display of several sets of indicia or sets of boxes 310, 320, 330 and 340 containing number indicia 44 on video display 40. In addition, the multiple choice display of set of indicia 310, 320, 330 and 340 are labeled with a label 84 such as, "1, 2, 3 or 4".

Label 1 corresponds to a second set of indicia 320 and includes box 320A containing the number "3", box 320B containing the number "2", box 320C containing the number "1" and box 320D containing the number "6". Label 3 corresponds to a third set of indicia 330 and includes box 330A containing the number "8", box 330B containing the number "4", box 330C containing the number "6" and box 330D containing the number "5". Label 2 corresponds to the first set of indicia 310 and includes box 310A containing the number "2", box 310B containing the number "6", box 310C containing the number "4" and box 310D containing the number "9". Label 4 corresponds to a fourth set of indicia 340 and includes box 340A containing the number "7", box 340B containing the number "1", box 340C containing the number "7" and box 340D containing the number The display of the four sets of indicia 310, 320, 330 and 340 may be displayed for a pre-determined period of time.

Controller 100 then prompts the player to select the set of indicia 310, 320, 330 or 340 that is the same as the set of indicia that were previously displayed on video display 40. The player uses buttons 60, 61, 62 and 63 to select the sets of indicia labeled "1, 2 3 or 4".

The player needs to remember the previously displayed numbers. In the embodiment shown in FIGS. 7, 8 and 9, the order of the numbers is irrelevant and is not necessary to remember. In FIG. 7, the correct answer is label 2 or set 310. It is noted that the numbers "6, 9, 2 and 4" in FIGS. 7 and 9 are the same numbers; however, the order or sequence is different. Gaming apparatus 300 allows a game player to play a memory game without having to remember the order or sequence of the indicia shown.

The player may be given a pre-determined period of time to use the buttons to make a selection. If after the period of time the player has not made a selection, controller 100 may randomly make a selection for the player.

Figure 10:
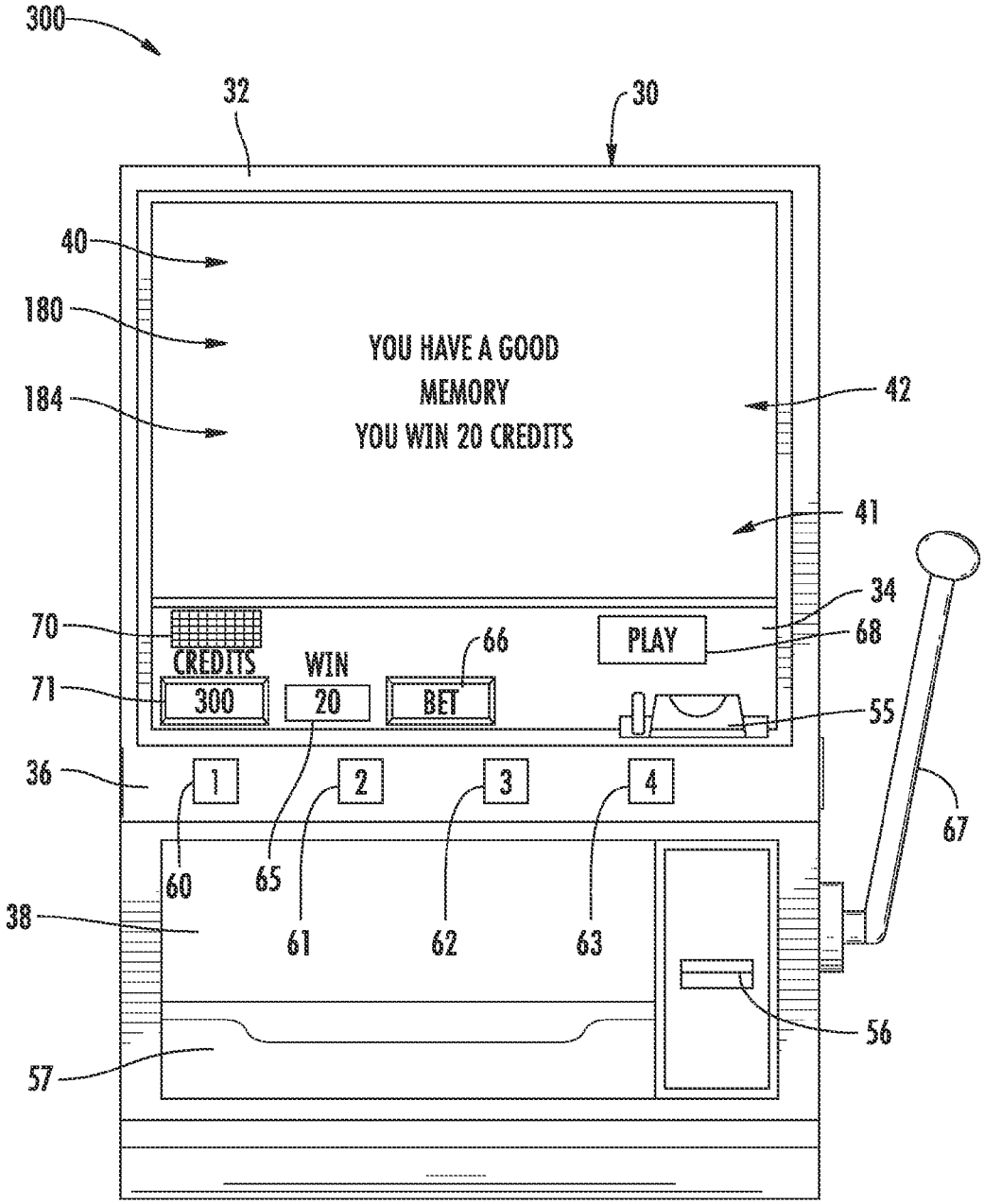
FIG. 10 is substantially a front elevation view of the gaming apparatus of FIG. 7 showing an additional embodiment of a game display.

If the player correctly selects the set of indicia that is the same as the previously displayed set of indicia, the player is awarded a prize. As shown in FIG. 10, the player has correctly selected the set of indicia labeled 2 by depressing button 61. Video display 40 can show a message 180 indicating that the player has a good memory and can show game information 184 indicating the game outcome including any prizes and the amount the player has won.

Gaming apparatus 300 can be played using the same game method 200 used for playing gaming apparatus 20 as previously described with reference to FIG. 6.

Third Embodiment

Figure 11:
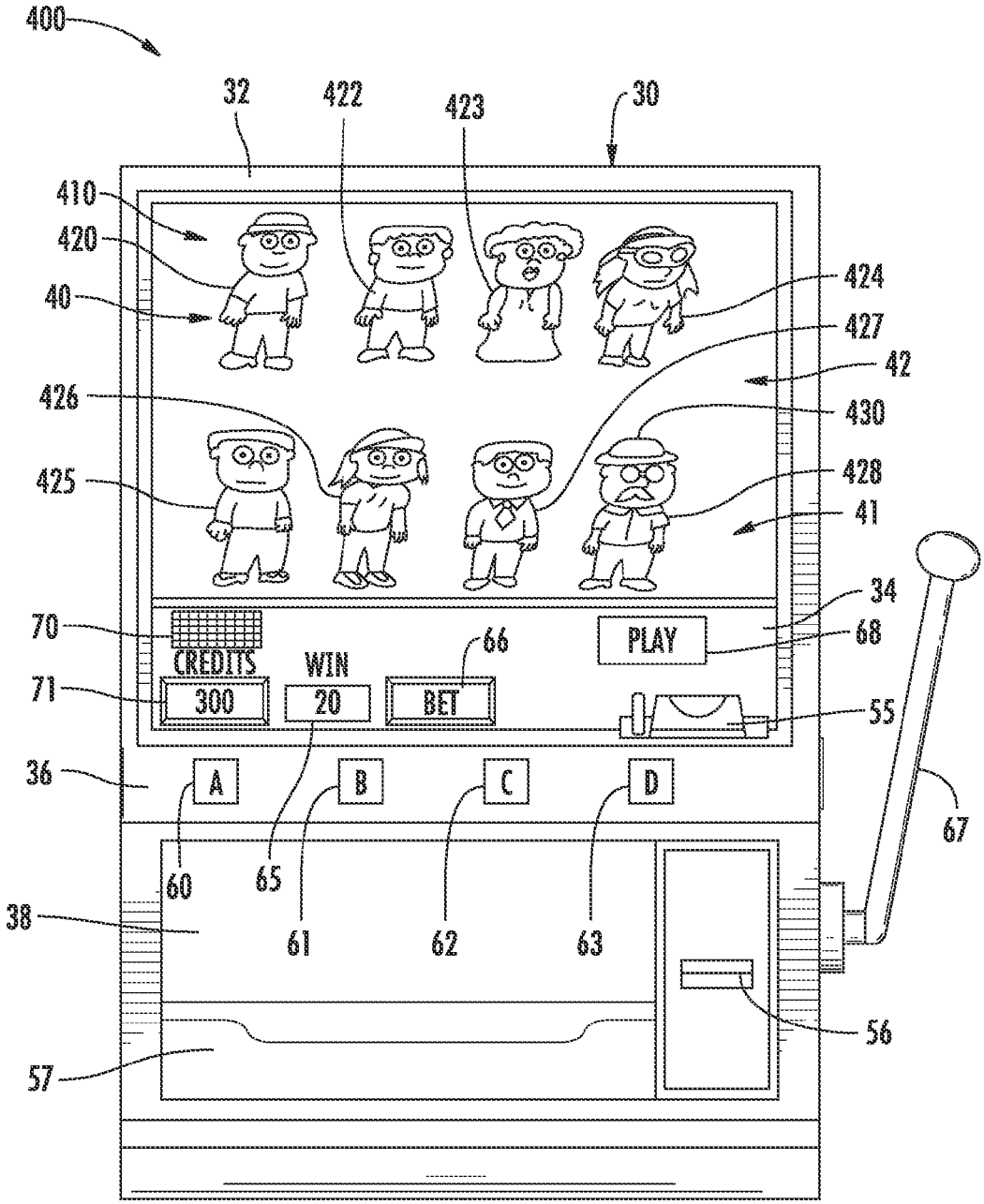
FIG. 11 is substantially a front elevation view of an additional embodiment of the gaming apparatus of the present invention.

With reference now to FIGS. 2 and 11, another embodiment of the present invention is shown. A gaming apparatus, generally indicated by reference number 400 is shown. Gaming apparatus 400 is similar to gaming apparatus 20 previously described except that a scene or picture 410 is shown on video display 40. Picture 410 can be a wide variety of images such as people, characters, buildings, outdoor images and objects.

Game display 42 may have several people or characters shown in picture 410. Picture 410 can include eight images of characters or persons 420, 422, 423, 424, 425, 426, 427 and 428. Each person or character in FIG. 11 has some unique attributes and also has some attributes in common with other characters. For example, character 428 has a mustache. Characters 420, 424, 426 and 428 are wearing hats. Character 427 is wearing a tie. Characters 424 and 428 are wearing glasses. A game player can be allowed to study picture 410 for a pre-determined period of time.

Button 60 is labeled "A". Button 61 is labeled "B". Button 62 is labeled "C". Button 63 is labeled "D".

Figure 12:
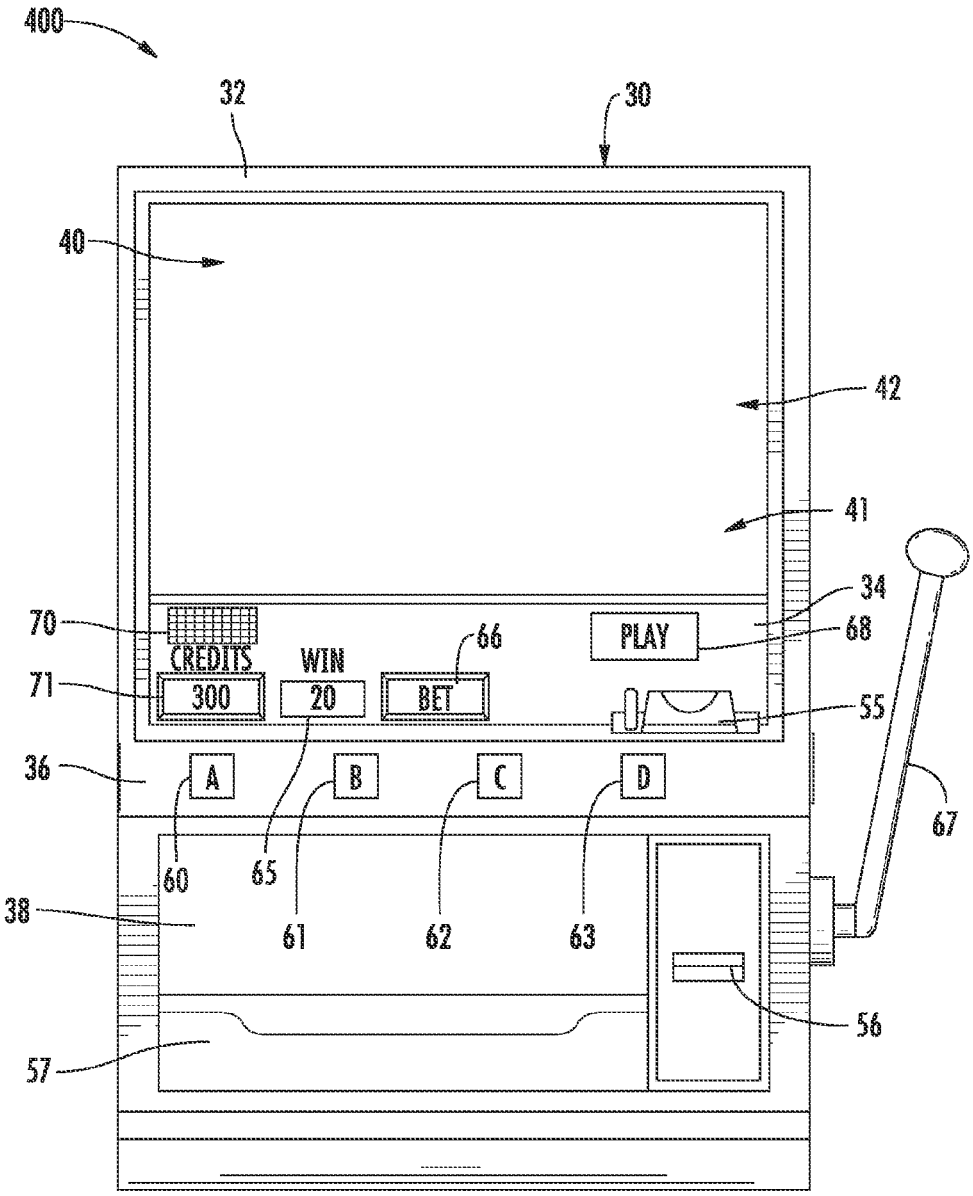
FIG. 12 is substantially a front elevation view of the gaming apparatus of FIG. 11 showing an embodiment of a game display.
Figure 13:
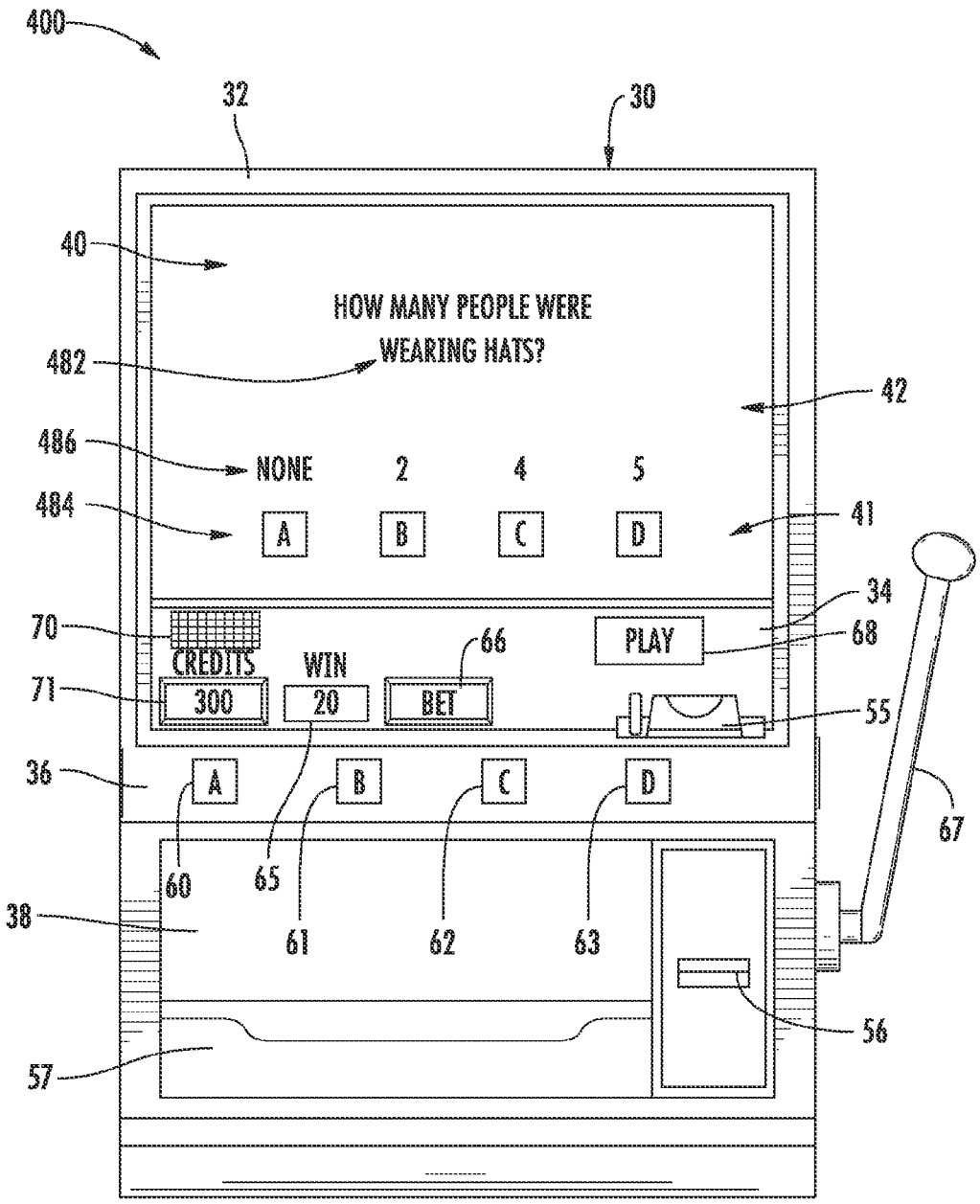
FIG. 13 is substantially a front elevation view of the gaming apparatus of FIG. 11 showing another embodiment of a game display.

Next, controller 100 then causes a blank video screen 40 to be displayed for a pre-determined period of time as shown in FIG. 12. Turning now to FIG. 13, controller 100 is shown displaying a question 482, a multiple choice list of answers 486 and corresponding list of buttons 484 to be depressed by the player to select one of the answers on video display 40. The question reads, "How many people were wearing hats?" The multiple choice list of answers 486 includes the values, "none", "2", "4" and "5". Button list 484 includes buttons "A", "B", "C" and "D".

Question 482, multiple choice list of answers 486 and corresponding list of buttons 484 may be displayed on video display 40 for a pre-determined period of time. Controller 100 then waits for the player to select an answer using buttons 60, 61, 62 and 63.

The player needs to recall or remember various attributes of the previously displayed picture 410 and then answer the question that is presented about the previously displayed picture 410. In FIG. 13, the correct answer is obtained by depressing button 62, which corresponds to four hats. Four characters were wearing hats in picture 410 of FIG. 11.

The player may be given a pre-determined period of time to use the buttons to make a selection. If after the period of time the player has not made a selection, controller 100 may randomly make a selection for the player.

Figure 14:
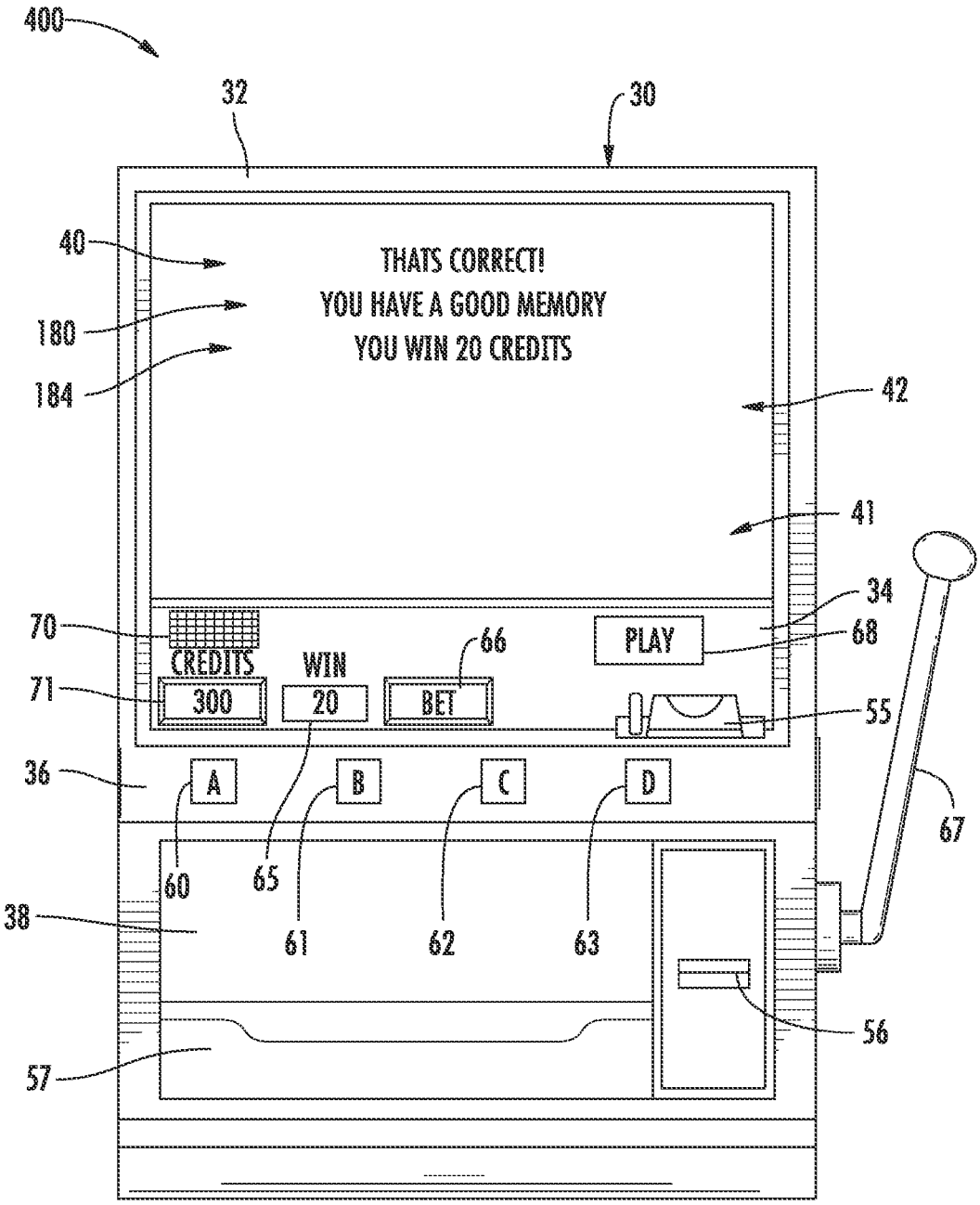
FIG. 14 is substantially a front elevation view of the gaming apparatus of FIG. 11 showing an additional embodiment of a game display.

If the player correctly answers question 482, the player is awarded a prize. As shown in FIG. 14, the player has correctly selected button 62 indicating that four hats were previously shown. Video display 40 indicates that the player has won 20 credits. Video display 40 can show a message 180 indicating that the player has a good memory and can show game information 184 indicating the game outcome including any prizes and the amount the player has won.

Controller 100 may randomly select questions to be asked of the game player of varying difficulty. For example, controller 100 may select questions that are easier to answer such as how many people are shown in picture 410. Controller 100 may select questions that are harder to answer about smaller details shown in picture 410. For example, controller 100 may ask a question about which characters were wearing belts or which characters had a certain hair color. A large number of pictures 410 and questions 482 may be stored in memory 96 for controller 100 to select from. The large number of pictures and questions prevents game players from being able to learn all of the questions and answers presented by gaming apparatus 400.

Gaming apparatus 400 allows a player to play a memory game. Gaming apparatus 400 shows a scene or picture and then the player is asked questions about the picture or scene later after the picture or scene has been removed. The player has to recall from memory attributes of the previously shown images.

Third Embodiment Game Method

Figure 15:
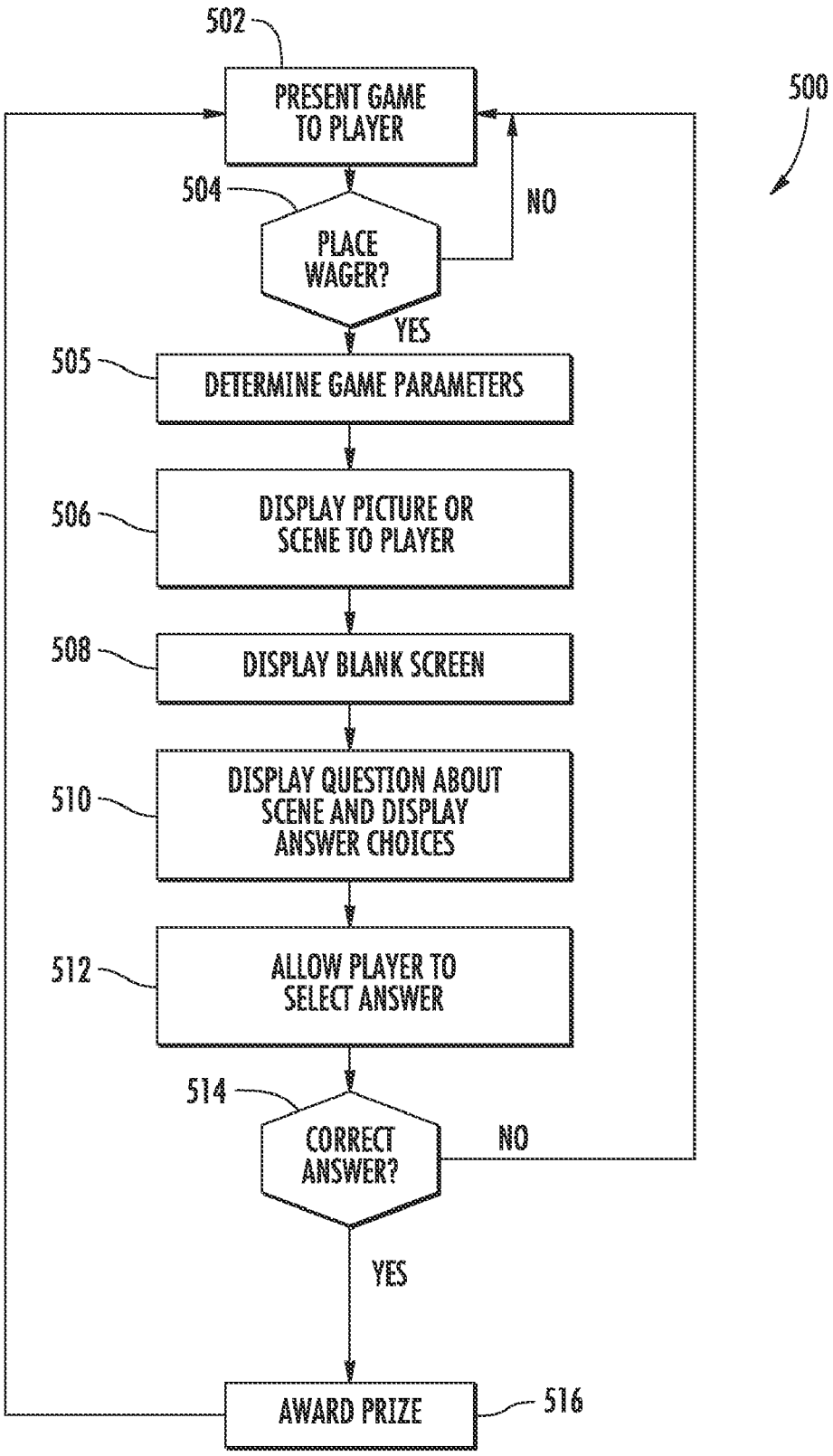
FIG. 15 is substantially a flowchart of another gaming method of the present invention.

Tuning now to FIGS. 11 and 15, a method 500 of playing gaming apparatus 400 is shown. The game is presented to the player in step 502. A player is allowed to place a wager on gaming apparatus 400 in step 504. At step 505, controller 100 may determine various game parameters. Step 505 may include determining the difficulty of the questions asked and the value of any prizes awarded for a correct choice by the player.

For example, during one game cycle, the questions asked may be easy questions to answer. During another game cycle, the questions asked may be harder or more difficult.

At step 506, the scene or picture is shown to the game player for the player to study for a period of time. The player may be prompted to study the picture. Next, a blank or empty video display screen is shown in step 508 for another period of time. Other types of displays may also be shown in step 508, such as animation, movie clips or music videos. At step 510, a question and a multiple choice set of answers about the picture can be shown to the player on video display 40 for period of time. At step 512, the player is allowed to select one of the answers using buttons 60-63.

At decision 514, method 500 checks to see if the player's choice is the correct answer to the question. If the player's choice is not correct, method 500 returns to step 502. If it is determined at decision 514 that the player's choice is correct, method 500 proceeds to step 516 where any prizes are awarded.

Method 500 then returns to step 502 where the player is allowed to play the game again. If the player chooses to play another game, the next game may be more difficult. In one embodiment, they may only play another game, if the outcome of the previous game was a game winning outcome. In this example, the next game may be more difficult.

In another embodiment, if a player loses the first game, the controller may adjust the next game to be easier. In this manner, the game can be adjusted to be challenging to game players of different skill levels.

The steps shown in the flowchart do not necessarily imply that the steps have to take place in a particular order. The order of steps may be varied; some steps may be eliminated; and, some steps may be replaced with other steps. Such variations still fall within the scope of the invention.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A gaming apparatus comprising:

(A) a gaming device that is adapted to accept a wager and allow a player to play at least one game;

(B) a display device positioned in association with the gaming device;

(C) a player input device mounted in association with the gaming device;

(D) a controller in communication with the gaming device, the display device and the player input device, the controller being configured to:

(a) cause the display device to display a first set of indicia;

(b) cause the display device to display a plurality of sets of indicia, the plurality of sets of indicia including the first set of indicia;

(c) allow the player to choose one of the plurality of sets of indicia using the player input device; and (d) award a prize, if the set of indicia chosen is the first set of indicia; and (E) wherein a blank display is shown after the display of the first set of indicia and before the plurality of sets of indicia are shown.

2. The gaming apparatus of claim 1 wherein the first set of indicia are displayed for a first period of time.

3. The gaming apparatus of claim 1 wherein the first set of indicia are in a first order.

4. The gaming apparatus of claim 3 wherein the chosen set of indicia are in the first order in order to win a prize.

5. The gaming apparatus of claim 1 wherein the game is a memory game.

6. The gaming apparatus of claim 1 wherein if the prize is awarded, allowing the player to play a second game.

7. A method of gaming, not all necessarily in the order shown comprising:

(A) displaying a first display having a first set of indicia;

(B) allowing a player to view the first set of indicia;

(C) displaying a second display having a plurality of sets of indicia;

(D) allowing the player to select one of the plurality of sets of indicia;

(E) if the set of indicia selected by the player is the same as the first set of indicia, awarding a prize; and (F) displaying a blank display before displaying the second display.

8. The method of claim 7 wherein the first set of indicia are in a pre-determined order.

9. The method of claim 8 wherein the prize is awarded if the player selects the first set of indicia in the pre-determined order.

10. The method of claim 8 wherein the prize is awarded is the player selects the first set of indicia in any order.

11. The method of claim 7 wherein the indicia are colors.

12. The method of claim 7 wherein the indicia are numbers.

13. The method of claim 7 wherein the player is allowed to memorize the first set of indicia during a first period of time.

14. The method of claim 7 further comprising: allowing the player to play a second game.

15. A method of gaming, not all necessarily in the order shown comprising:

(A) displaying a first set of indicia for a first time period;

(B) allowing a player to view the first set of indicia during the first time period;

(C) displaying at least the first set of indicia and a second set of indicia for a second time period;

(D) allowing the player to select one of the sets of indicia during the second time period;

(E) if the set of indicia selected by the player is the first set of indicia, awarding a prize; and (F) displaying a blank display between the first and second time periods.

16. The method of claim 15 wherein the indicia are pictures.

17. The method of claim 15 wherein the indicia are shapes.

18. The method of claim 15 wherein the player is allowed to memorize the first set of indicia during the first time period.

19. The method of claim 15 wherein the player is allowed to remember the first set of indicia during the second time period.

20. The method of claim 15 wherein the sets of indicia are in a pre-determined order.

21. A gaming apparatus comprising:

(A) means for accepting a wager and playing a first game;

(B) means for displaying a first set of indicia;

(C) means for displaying a plurality of sets of indicia, the plurality of sets of indicia including the first set of indicia;

(D) means for a player to select at least one of the plurality of sets of indicia;

(E) means for awarding a prize, if the selected set of indicia is the first set of indicia; and (F) wherein a blank display is shown after the display of the first set of indicia and before the plurality of sets of indicia are shown.

22. The gaming apparatus of claim 21 wherein the first set of indicia are displayed for a first period of time such that the first set of indicia may be memorized.

23. The gaming apparatus of claim 21 wherein the first set of indicia are arranged in a first order.

24. The gaming apparatus of claim 23 wherein the prize is awarded if the selected set of indicia is the first set of indicia in the first order.

25. The gaming apparatus of claim 21 wherein the plurality of sets indicia are displayed for a second period of time such that the first set of indicia may be remembered.

26. The gaming apparatus of claim 21 wherein if the prize is awarded, allowing a player to play a second game.

27. A gaming apparatus comprising:

(A) a gaming device that is adapted to accept a wager and allow a player to play at least one game;

(B) a display positioned in association with the gaming device;

(C) a player input device mounted in association with the gaming device; and (D) a controller in communication with the gaming device, the display and the player input device, the controller being configured to:

(a) cause the display to display an image;

(b) ask a question about the image;

(c) allow the player to select an answer to the question; and (d) award a prize, if the answer is correct.

28. The gaming apparatus of claim 27 wherein a plurality of answers to the question are provided for the player to select from.

29. The gaming apparatus of claim 28 wherein a blank display is shown before the question is asked.

30. A method of gaming, not all necessarily in the order shown comprising:

(A) displaying a first display having an image;

(B) allowing a player to view the image;

(C) displaying a second display having a question about the image;

(D) allowing the player to select an answer to the question; and (E) if the answer to the question is correct, awarding a prize.

31. The method of claim 30 further comprising: displaying a blank display before displaying the second display.

32. The method of claim 31 further comprising: displaying a set of answers to the question.

* * * * *